United States Patent [19]

Murata et al.

[11] 4,216,060

[45] Aug. 5, 1980

[54] HORIZONTAL TYPE COKE OVENS

[75] Inventors: Hidemi Murata; Koretoshi Fujishiro; Shunsaku Hiraga; Masamitu Hiyoshi, all of Kagawa, Japan

[73] Assignee: Mitsubishi Kasei Kogyo Kabushiki Kaisha, Tokyo, Japan

[21] Appl. No.: 904,409

[22] Filed: May 10, 1978

[51] Int. Cl.[2] ..... C10B 5/02

[52] U.S. Cl. ..... 202/139; 110/203; 110/345; 423/235; 423/239; 432/72; 202/146

[58] Field of Search ..... 202/138–146; 423/235, 239 A; 110/203, 210, 212, 345; 432/72

[56] References Cited

U.S. PATENT DOCUMENTS

| | | | |
|---|---|---|---|
| 3,599,427 | 8/1971 | Jones et al. | 23/288 F |
| 3,846,981 | 11/1974 | Paczkowski | 423/235 X |
| 3,900,554 | 8/1975 | Lyon | 423/235 |
| 3,945,331 | 3/1976 | Drake et al. | 110/203 X |
| 3,963,582 | 6/1976 | Helm et al. | 202/139 X |
| 4,051,225 | 9/1977 | Shiga et al. | 110/345 X |
| 4,113,838 | 9/1978 | Koike et al. | 423/235 |
| 4,140,654 | 2/1979 | Yoshioke et al. | 423/239 X |

FOREIGN PATENT DOCUMENTS

| | | | |
|---|---|---|---|
| 49-11775 | 2/1974 | Japan | 423/235 |
| 51-5266 | 1/1976 | Japan | 423/235 |
| 51-92782 | 8/1976 | Japan | 423/239 A |

*Primary Examiner*—Joseph Scovronek
*Assistant Examiner*—Roger F. Phillips
*Attorney, Agent, or Firm*—Oblon, Fisher, Spivak, McClelland & Maier

[57] ABSTRACT

In a horizontal type coke oven, high temperature waste gas generated in a heating flue chamber and containing nitrogen oxides is discharged into a regenerator. There are provided nozzle openings for injecting ammonia or ammonia precursor to the high temperature waste gas at a position where the temperature of the waste gas is about 750°–1000° C. so as to reduce the nitrogen oxides in the waste gas with the ammonia or ammonia precursor.

5 Claims, 7 Drawing Figures

HORIZONTAL TYPE COKE OVENS

BACKGROUND OF THE INVENTION

This invention relates to a coke oven and more particularly, a coke oven having an improved regenerator for reducing nitrogen oxides in waste gas generated in the coke oven thereby preventing environmental pollution.

In a known horizontal type coke oven, such as an Ottotype, Koppers-type and Carl-Still-type coke oven, fuel gas fed from one duct is heated and burned in a heating flue chamber for a predetermined time and the waste gas is discharged into atmosphere through a duct, a regenerator disposed below the heating flue chamber and a flue. The temperature of the waste gas entering into the regenerator is generally is about 750–1000° C. In this process, bricks constituting the walls of the regenerator is heated by the high temperature waste gas and the heat is stored in the regenerator. The heat stored in the regenerator is fed to the heating flue chamber through another duct and is used for preheating air for the combustion.

The waste gas contains harmful substances, for example nitrogen oxides (abbreviated as $NO_x$ hereinbelow), which cause environmental air pollusion. In the prior art, such $NO_x$ were discharged through the flue of the coke oven into the atmosphere without being subjected to any treatment for removing $NO_x$ therefore, the discharged $NO_x$ became one factor that causes photochemical smog.

SUMMARY OF THE INVENTION

Accordingly, it is an object of this invention to provide an improved coke oven capable of discharging the waste gas containing substantially no $NO_x$ into the atmosphere through the flue of the coke oven.

According to this invention, there is provided a horizontal type coke oven in which waste gas generated in a heating flue chamber is discharged into a regenerator cell. The coke oven is provided with nozzle openings for injecting ammonia or ammonia precursor into a flow passage of the waste gas from the heating flue chamber and at a position where the temperature of the waste gas is 750–1000° C. so as to reduce nitrogen oxides in the waste gas with the ammonia or ammonia precursor.

In the coke oven of this invention, the above described object is accomplished by applying the fact that $NO_x$ are reducted to molecular nitrogen with ammonia at a temperature of about 750–1000° C. Namely, $NO_x$ in the waste gas are removed by injecting ammonia into and mixing it with the waste gas, the temperature of which is about 750–1000° C. near the inlet at the top of the regenerator cell, in the presence of oxygen, and $NO_x$ are then reduced to molecular nitrogen in the absence of oxygen.

The injection of the ammonia can be made by any known means, but usually, it is advantageous to inject the ammonia, which is fed from a supply tank disposed externally of the coke oven, into the regenerator cell through a duct and the walls of the regenerator cell. In one typical manner, the ammonia is injected into the regenerator cell directly from the inside surface of the wall thereof or through a pipe made of quartz, for example, and provided with a plurality of nozzles. However, any other manner can be used so long as the ammonia can be sufficiently contacted to and mixed with the waste gas. In this case, since an ammonia feed pipe is located under high temperature condition, it is desirable to prevent the thermal decomposition of the ammonia in the feed pipe before it is injected into the waste gas by applying heat shielding means such as a water jacket or by using a pipe made of quartz or ceramics. The amount of ammonia to be injected is selectively used among 0.8–20 moles, preferably, 0.8–10 moles and industrially, 0.8–5 moles with respect to 1 mole of NO of $NO_x$ in the waste gas.

Furthermore, it is not necessary to store the ammonia as pure ammonia before use and it is also possible to use substances such as ammonium carbonate or the like, generally called ammonia precursor, which are easily decomposed at a temperature of about 750–1000° C. to generate ammonia when the substance is mixed with the waste gas containing $NO_x$. Furthermore, an ammonia mixture such as coke oven gas containing hydrocarbon gas may also be used instead of the pure ammonia.

Although the ammonia is usually diluted before the use with steam or inert gas such as nitrogen or the like, it is also possible to feed the ammonia together with hydrogen, and in the latter case, $NO_x$ in the waste gas can be effectively reduced by changing the mixing ratio of the ammonia with the hydrogen in accordance with the temperature of the waste gas.

This invention will become more apparent from the following description made in conjunction with the accompanying drawings.

BRIEF DESCRIPTION OF THE DRAWINGS

In the accompanying drawings.

DESCRIPTION OF THE PREFERRED EMBODIMENTS

Figure 1:
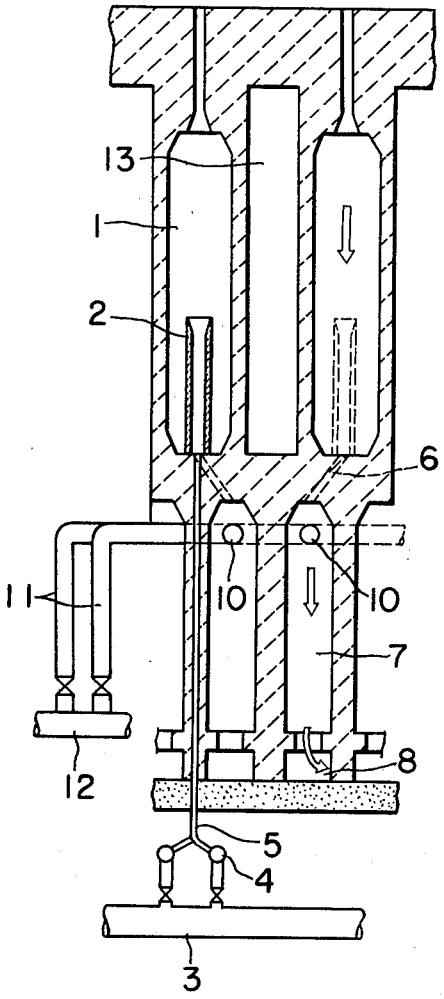
FIG. 1 is a partial transverse sectional view of one embodiment of a coke oven according to this invention.
Figure 2:
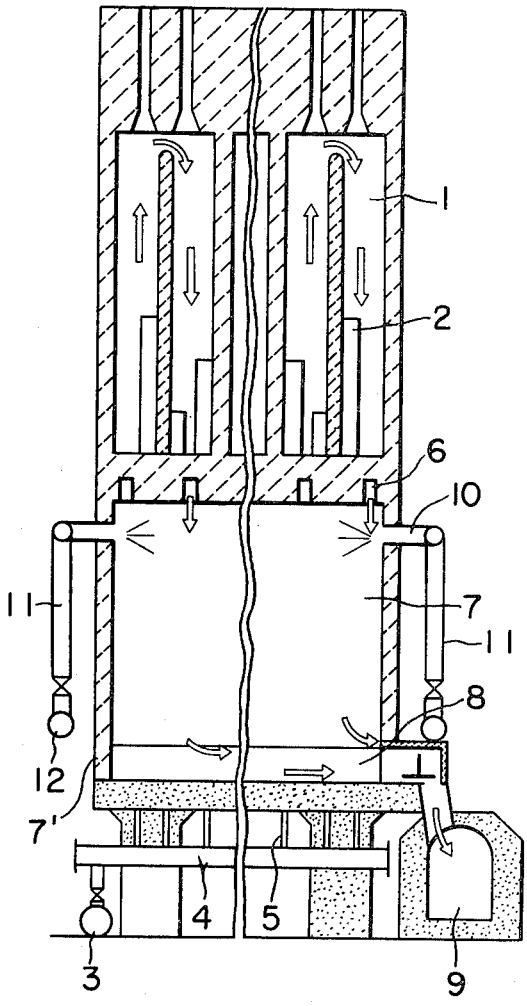
FIG. 2 is a partial longitudinal sectional view of the coke oven shown in FIG. 1.

In a perferred embodiment of the coke oven of this invention, shown in FIGS. 1 and 2, two nozzles 10 are disposed to oppose the side walls 7' of the top portion of a regenerator cell 7. Coke oven gas is fed into heating flue chambers 1 through a main pipe 3, branch pipes 4, jet pies 5 and refractory burners 2 and burnt thereby. Waste gas generated in the heating flue chambers 1 is discharged to the outside of the coke oven through gas ducts 6, regenerator cells 7 located below the heating flue chambers 1, sole flues 8 and a waste gas flue 9, as shown by arrows in FIGS. 1 and 2. Nozzles 10 are provided for the regenerator cell 7 at the upper end of the side walls thereof and opened in the regenerator cell and ammonia or ammonia precursor is injected into the regenerator cell 7 through a main pipe 12, ammonia guide pipes 11 and the nozzles 10. In this case, it is desirable to inject ammonia at the same time as the discharge of the waste gas in the regenerator cell 7. Reference numeral 13 designates an oven chamber, and in the illustrated embodiment, regenerator cell filling bricks are not shown.

The ammonia is mixed with the waste gas having a temperature of about 750–1000° C. in the regenerator cell 7 in a manner described herein above and $NO_x$ in the waste gas are then reduced to the molecular nitrogen. Thus, the exhaust gas discharged from the waste gas flue 9 contains substantially no $NO_x$.

Figure 3:
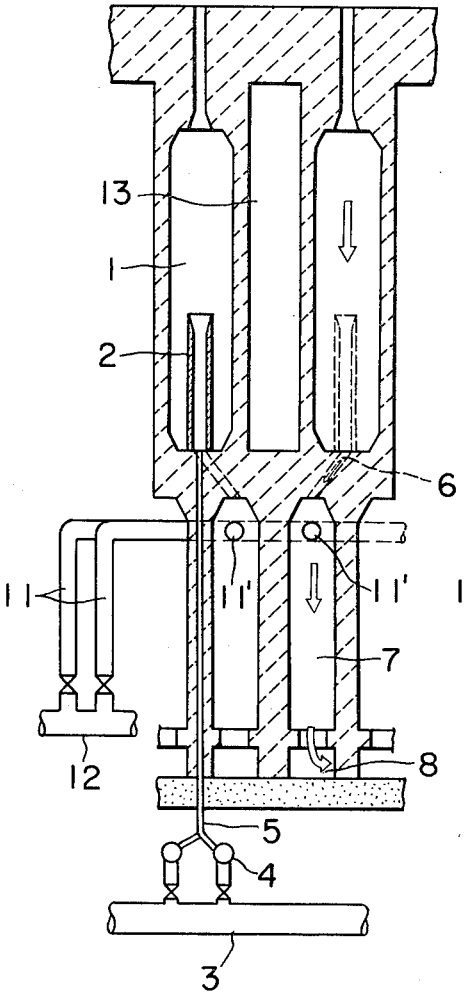
FIG. 3 is a partial transverse sectional view of another embodiment of a coke oven according to this invention.
Figure 4:
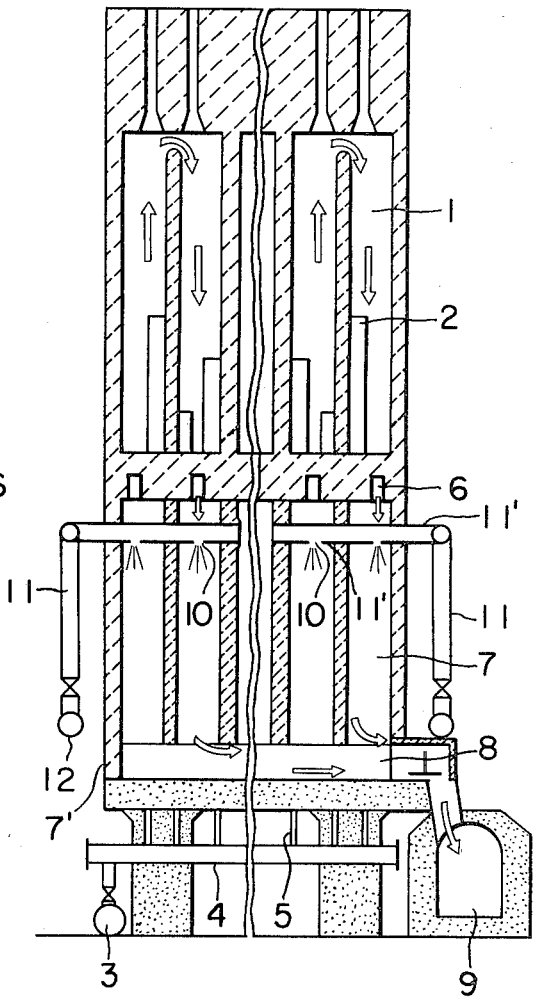
FIG. 4 is a partial longitudinal sectional view of the coke oven shown in FIG. 3.

FIGS. 3 and 4 show partial sectional views of another embodiment of the coke oven of this invention, in which the same reference numerals are applied to the same parts shown in FIGS. 1 and 2 (the same is true in the other embodiments described hereinafter). In FIGS. 3 and 4, the ammonia guide pipes 11 further extends into the regenerator cell 7 through the side walls thereof as through pipes 11'. The provision of a plurality of nozzles 10 ensures uniform injection of the ammonia into the regenerator cell 7 at the top portion thereof and the more efficient mixing of the ammonia with the waste gas.

Figure 5:
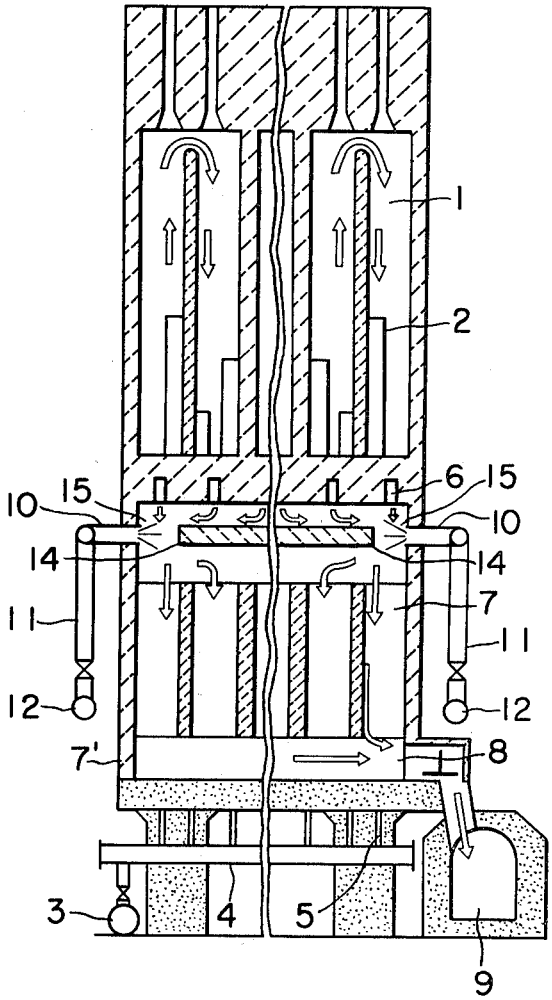
FIG. 5 is a partial longitudinal sectional view of a further embodiment of a coke oven according to this invention.

In FIG. 5 a horizontal obstruction wall 14 is disposed at the upper portion of the regenerator cell 7 where the temperature of the waste gas is about 750–1000° C. so that the waste gas discharged from the ducts 6 collides against the obstruction wall 14 at substantially right angles, then flows therealong and finally enters into the inside of the regenerator cell 7 through a gas passage 15 formed between the obstruction wall 14 and the inside surface of the side walls of the regenerator. In this embodiment, the ammonia is injected from the nozzles 10 provided for the opposing side walls 7' and mixed with the waste gas at the considerably narrow gas passage 15. Therefore, $NO_x$ contained in the waste gas of the temperature of about 750–1000° C. are reduced to the molecular nitrogen before entering into the inside of the regenerator cell 7. Thus, the waste gas discharged from the waste gas flue 9 contains substantially no $NO_x$. In this modified coke oven, since the whole waste gas flows through the considerably narrow gas passage 15, the ammonia can be smoothly and uniformly injected into and mixed with the waste gas, whereby $NO_x$ are effectively reduced and removed.

Figure 6:
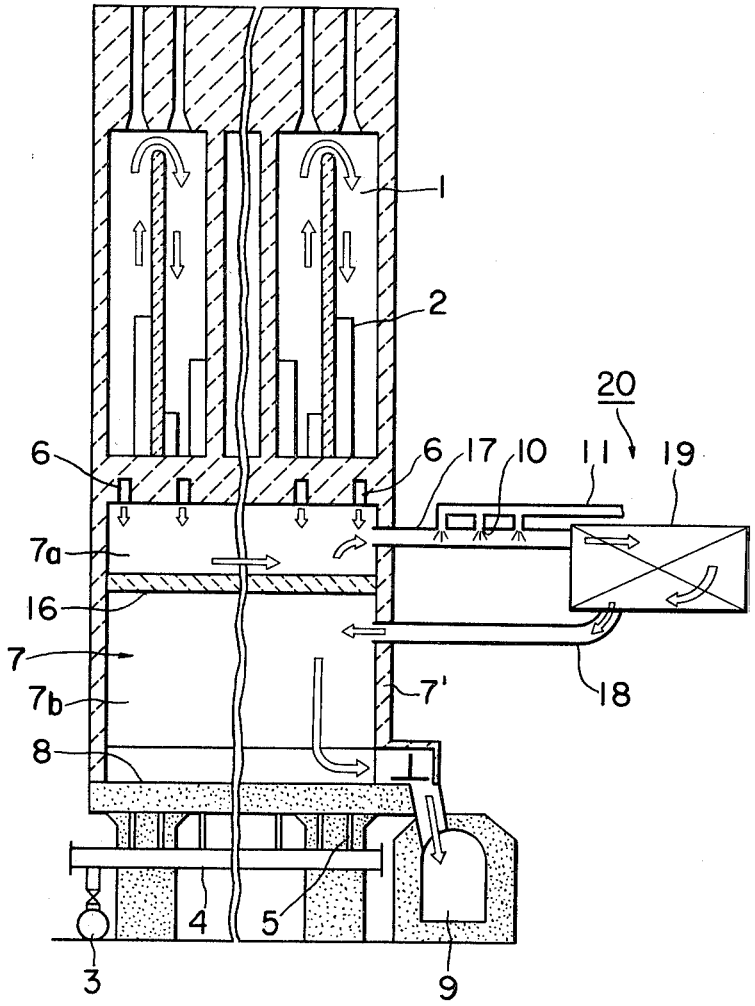
FIG. 6 is a partial longitudinal sectional view of a still further embodiment of a coke oven according to this invention.

With a further modified coke oven shown in FIG. 6, the regenerator cell 7 is divided into two chambers **7*a* and 7*b* by a horizontal obstruction wall 16 disposed across the side walls 7', and a waste gas conduit system 20 for communicating the upper chamber 7*a* with the lower chamber 7*b* is located to the outside of the regenerator cell 7. Heat recovery means, such as a heat exchanger 19 is provided for the waste gas conduit system 20 and a plurality of nozzles 10 for injecting the ammonia are provided for an ammonia mixing pipe 17 on the upstream side of the conduit system 20. The upper chamber 7*a* is constructed in a zone where the temperature of the waste gas supplied from ducts 6 is about 750–1000° C. In this embodiment, the coke oven gas is fed into the heating flue chamber 1 through the main pipe 3, the branch pipes, and the jet pipes 5 and burnt by the refractory burner 2. The waste gas generated in the heating flue chamber 1 enters through the ducts 6 into the upper chamber 7*a* of the regenerator cell 7. The waste gas is then guided to the conduit system 20 and mixed with the ammonia injected from the nozzles 10. The waste gas is introduced into the lower chamber 7*b* of the regenerator cell 7 through the ammonia mixing pipe 17, the heat exchanger 19 and a guide pipe 18, then preheats the regenerator cell 7 and is discharged externally of the coke oven through the waste gas flue 9**.

$NO_x$ in the waste gas are reduced to the molecular nitrogen when it passes through the ammonia mixing pipe 17, and the provision of the heat exchanger 19 compensates for the heat loss of the waste gas caused by the passage thereof through the conduit system 20.

Figure 7:
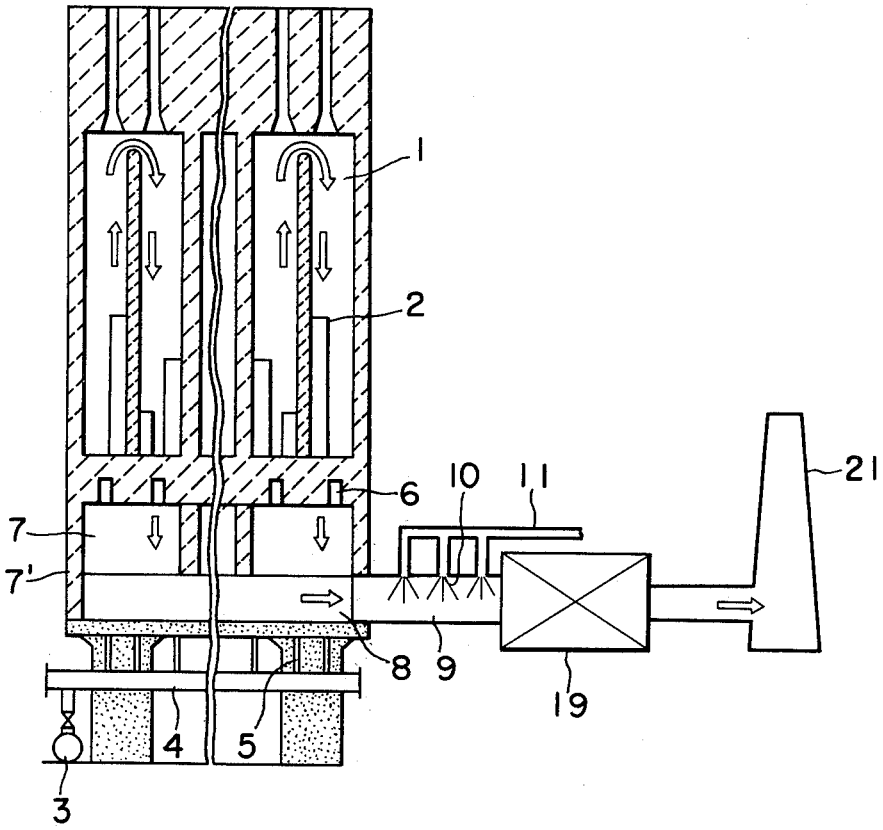
FIG. 7 is a partial longitudinal sectional view of the other embodiment of a coke oven according to this invention.

In the coke oven shown in FIG. 7, the regenerator cell 7 is designed to be more compact than a conventional horizontal type coke oven. The sole flue 8 in this coke oven is connected with the waste gas flue 9 provided with a plurality of ammonia injecting nozzles 10 and a heat exchanger 19. Although the temperature of the waste gas entering into the regenerator through the ducts 6 is about 900–1100° C., the regenerator of the coke oven of this type is designed so that the temperature thereof will be about 750–1000° C. when it is discharged from the sole flue 8.

Thus, $NO_x$ in the waste gas are reduced to the molecular nitrogen with the ammonia injected from the nozzles 10 while they pass through the waste gas flue 9, and the waste gas discharged from a stack 21 contains substantially no $NO_x$. The heat recovered by the heat exchanger 19 is used for preheating air to be supplied to the regenerator cell 7.

As is understood from the foregoing description made in conjunction with the preferred embodiments of this invention, $NO_x$ contained in the waste gas of the coke oven can be reduced to the molecular nitrogen and removed by feeding the ammonia or ammonia precursor, thus preventing the environmental air pollusion, and since the regenerator is constructed compact, the whole structure of the coke oven is made small and fundation work and brick pilling work which are essential for the conventional horizontal type coke oven are simplified or eliminated, thus reducing the cost of construction.

What is claimed is:

1. In a horizontal type coke oven in which gas generated in one of a plurality of vertically disposed heating flue chambers is discharged into one of a plurality of vertically disposed regenerator cells horizontally juxtaposed to said heating flue chambers, the improvement wherein there are provided nozzle openings for injecting ammonia or ammonia precursor into a flow passage of the waste gas from said heating flue chamber and at a top portion of said regenerator cell where the temperature of the waste gas is 750–1000° C. so as to reduce nitrogen oxides in the waste gas with the ammonia or ammonia precursor.

2. The horizontal type coke oven according to claim 1 wherein said ammonia or ammonia precursor contains hydrocarbon gas.

3. The horizontal type coke oven according to claim 1 wherein a horizontal obstruction wall is disposed at the upper portion of said regenerator cell so that the waste gas discharged from said heating flue chamber will collide against said horizontal obstruction wall, flow therealong outwardly and pass through passages formed between the ends of said the obstruction wall and the inside surfaces of the side walls of said regenerator cell and wherein there are provided nozzle openings for injecting ammonia or ammonia precursor into the waste gas passing through said passages.

4. The horizontal type coke oven according to claim 1 wherein a horizontal obstruction wall is disposed in said regenerator cell across the side walls thereof so as to divide the regenerator cell into two chambers, said two chambers being communicated with each other through a waste gas conduit system located outside of said regenerator cell, and said conduit system including heat recovery means and being provided with nozzle openings for injecting ammonia or ammonia precursor into said waste gas on the upstream side of said heat recovery means.

5. The horizontal type coke oven according to claim 1 wherein said regenerator cell has a height smaller than that of a conventional regenerator so as to maintain the temperature of the waste gas at 750–1000° C. at the outlet flue of said regenerator, and said outlet flue is provided with nozzle openings for injecting ammonia or ammonia precursor into said waste gas, and a heat exchanger on the downstream side of said nozzle openings.

* * * * *